US008956235B2

(12) United States Patent
Cheng

(10) Patent No.: US 8,956,235 B2
(45) Date of Patent: Feb. 17, 2015

(54) EXPANSION/COLLAPSE CONTROL MECHANISM FOR POLICE BATON

(71) Applicant: Kantas Products Co., Ltd., Taipei (TW)

(72) Inventor: Yang-Fu Cheng, Taipei (TW)

(73) Assignee: Kantas Products Co., Ltd., Taipei (TW)

( * ) Notice: Subject to any disclaimer, the term of this patent is extended or adjusted under 35 U.S.C. 154(b) by 0 days.

(21) Appl. No.: 14/024,735

(22) Filed: Sep. 12, 2013

(65) Prior Publication Data

US 2014/0256452 A1 Sep. 11, 2014

(30) Foreign Application Priority Data

Mar. 6, 2013 (TW) ..... 102107808 A

(51) Int. Cl.
*F41B 15/02* (2006.01)

(52) U.S. Cl.
CPC ..... *F41B 15/027* (2013.01)
USPC ..... 463/47.2; 463/47.7

(58) Field of Classification Search
USPC ..... 463/47.2, 47.7; 135/75; 15/144.4
See application file for complete search history.

(56) References Cited

U.S. PATENT DOCUMENTS 2,757,002 A * 7/1956 Ryden ..... 43/4
4,037,839 A * 7/1977 Nelson ..... 463/47.7
4,132,409 A * 1/1979 Taylor ..... 463/47.6
4,135,719 A * 1/1979 Braunhut ..... 463/47.7
4,456,255 A * 6/1984 Braunhut ..... 463/47.7
4,522,398 A * 6/1985 Swartz et al. ..... 463/47.2
4,657,986 A * 4/1987 Isayama et al. ..... 525/407
4,703,932 A * 11/1987 Kubota ..... 463/47.6
4,982,960 A * 1/1991 David ..... 463/47.6
5,031,827 A * 7/1991 von Braunhut ..... 231/3
5,085,433 A * 2/1992 Parsons ..... 463/47.6
5,108,097 A * 4/1992 Ashihara ..... 463/47.6
5,356,139 A * 10/1994 Parsons ..... 463/47.7
5,372,363 A * 12/1994 Siddle ..... 463/47.7
5,529,300 A * 6/1996 Frazier et al. ..... 463/47.4
5,568,922 A * 10/1996 Siddle ..... 463/47.7
5,647,591 A * 7/1997 Parsons ..... 463/47.4
5,690,552 A * 11/1997 Siddle ..... 463/47.7
5,868,621 A * 2/1999 Parsons ..... 463/47.7
5,947,352 A * 9/1999 Parsons ..... 224/250
6,070,987 A * 6/2000 Jarvik ..... 362/84
H1947 H * 3/2001 Starrett ..... 463/47.7
6,223,441 B1 * 5/2001 Parsons ..... 30/367
6,231,447 B1 * 5/2001 Pelkey ..... 463/47.7
6,238,292 B1 * 5/2001 Pelkey ..... 463/47.7
6,386,726 B1 * 5/2002 Macierowski et al. ..... 362/102
6,463,688 B1 * 10/2002 Idehara ..... 42/1.16

(Continued)

*Primary Examiner* — William Pierce
(74) *Attorney, Agent, or Firm* — Bacon & Thomas, PLLC

(57) ABSTRACT

A police baton including an outer tube and an inner tube connected in a telescoping manner, and clutch locking and releasing mechanisms provided at first ends of the inner and outer tubes respectively. When the inner tube is moved outward of the outer tube until the first end of the inner tube presses against a second end of the outer tube, a clutch locking block of the clutch locking mechanism moves laterally outward due to an elastic force and is embedded into a retaining groove on the outer tube, thereby forming a long stick. When a releasing shaft of the releasing mechanism is inserted into a releasing groove on the clutch locking block, the clutch locking block is moved laterally inward and released from the retaining groove, thereby allowing the inner tube to move toward the outer tube for forming a short stick.

13 Claims, 5 Drawing Sheets

(56) References Cited

U.S. PATENT DOCUMENTS

| | | | | |
|---|---|---|---|---|
| 6,499,855 | B1 * | 12/2002 | Kukuk | 362/102 |
| 6,543,365 | B1 * | 4/2003 | Vasel et al. | 102/502 |
| 6,615,622 | B2 * | 9/2003 | MacAleese et al. | 70/16 |
| 6,761,639 | B2 * | 7/2004 | Todd | 463/47.2 |
| 7,194,960 | B2 * | 3/2007 | Vasel et al. | 102/502 |
| 7,488,255 | B2 * | 2/2009 | Labes | 463/47.7 |
| 2002/0144446 | A1 * | 10/2002 | Lindahl | 42/1.16 |
| 2005/0082321 | A1 * | 4/2005 | Macierowski et al. | 224/197 |
| 2007/0087844 | A1 * | 4/2007 | Labes | 463/47.2 |
| 2013/0150167 | A1 * | 6/2013 | Pelkey | 463/47.7 |

* cited by examiner

EXPANSION/COLLAPSE CONTROL MECHANISM FOR POLICE BATON

FIELD OF THE INVENTION

The present invention relates to a police baton, more particularly to a police baton having an outer tube and an inner tube connected with each other in a telescoping manner, which can be operated as a long stick or a short stick by pressing a button thereof.

BACKGROUND OF THE INVENTION

Expandable police batons are a powerful defensive tool in military or anti-riot activities. An expandable police baton can be either expanded to form a long stick for deterrence or telescoped into itself to form a short stick for ease of carry and storage. It is common nowadays for security guards, law enforcement officers, or other security personnel to carry an expandable police baton with them in order to effectively protect people and their homes and properties, sometimes including the baton users themselves. In light of the fact that expandable police batons are advantageously easy to carry and master, ordinary people may also find the batons useful and keep them handy for self-protection.

A conventional expandable police baton is shown in FIG. 1. The expandable police baton 1 has a three-section structure composed essentially of three hollow tubes of different diameters, namely an outer tube 10, a middle tube 12, and an inner tube 13. The outer tube 10 is larger in diameter than the middle tube 12, and the middle tube 12 is larger in diameter than the inner tube 13. The inner tube 13 can be telescoped into the middle tube 12, and the middle tube 12, into the outer tube 10. When the outer tube 10 of the expandable police baton 1 is held and forcefully swung, the middle tube 12 and the inner tube 13 protrude from the outer tube 10 and then mutually engage with each other such that the expandable police baton 1 is expanded and forms a long stick. When a pressure is subsequently applied to the expandable police baton 1, the inner tube 13 and the middle tube 12 are successively telescoped into the outer tube 10 to form a short stick for ease of carry and storage.

The bottom end of the outer tube 10 is provided with a detachable cover 14. The cover 14 has a receiving space in which an engaging elastic strip 143 is fixed with a corresponding screw 141. When the expandable police baton 1 is pressured in such a way that the inner tube 13 and the middle tube 12 are telescoped into the outer tube 10 to form a short stick, the inner tube 13 is precisely engaged with the engaging elastic strip 143 and tightly secured against loosening. Besides, the front end of the inner tube 13 is provided with a head 15 having a greater outer diameter than the inner tube 13, thereby confining both the inner tube 13 and the middle tube 12 inside the outer tube 10. Moreover, the outer surface of the outer tube 10 is covered with a layer of foam 11 such that the outer tube 10 can be easily held without sliding.

It should be noted that the tubes 10, 12, and 13 of the expandable police baton 1 are mutually engaged through the differences between their diameters. Hence, after long-term use, the engaging portions of the tubes 10, 12, and 13 are prone to be worn or be deformed due to metal fatigue. In either case, engagement between the tubes 10, 12, and 13 will be compromised, if not severely loosened. In addition, once the expandable police baton 1 forms a long stick by mutual engagement between the tubes 10, 12, and 13, the baton cannot be collapsed unless the head 15 is hit with force to release the tubes 10, 12, and 13 from mutual engagement.

Frequent telescoping of the tubes 10, 12, and 13, however, not only aggravates wear and tear but also causes enormous noise that may frighten people nearby. Therefore, the issue to be addressed by the present invention is to provide a solution to the aforementioned problems of the conventional expandable police batons.

BRIEF SUMMARY OF THE INVENTION

In view of the fact that foregoing problems of the conventional expandable police batons have become limitations on market competitiveness of such batons, the inventor conducted continual research and experiments and finally succeeded in developing an expansion/collapse control mechanism for police batons in order to solve the foregoing problems and extend the service lives of police batons.

It is an object of the present invention to provide an expansion/collapse control mechanism for a police baton, wherein the police baton includes an outer tube and an inner tube which are connected to each other in a telescoping manner. The expansion/collapse control mechanism includes a clutch locking mechanism and a releasing mechanism. The clutch locking mechanism is provided on the inner tube and is adjacent to a first end of the inner tube. A second end of the inner tube can pass through the outer tube by way of a first end of the outer tube and be exposed from a second end of the outer tube. The outer diameter of the first end of the inner tube is greater than the inner diameter of the second end of the outer tube so that the first end of the inner tube will not separate from the second end of the outer tube. The inner wall of the outer tube is provided with a retaining groove adjacent to the second end of the outer tube. When the inner tube is forced to move outward of the second end of the outer tube such that the first end of the inner tube is pressed against the second end of the outer tube, at least one of the clutch locking blocks of the clutch locking mechanism moves laterally outward due to an elastic force and becomes embedded in the retaining groove. As a result, the first end of the inner tube is positioned in the second end of the outer tube and kept from moving, and the tubes are thereby expanded to form a long stick. The releasing mechanism, on the other hand, is fixedly provided at the first end of the outer tube. The releasing mechanism includes a releasing shaft whose first end is exposed from the first end of the outer tube, and whose second end can extend into the inner tube by way of the first end of the outer tube. When the clutch locking blocks are embedded in the retaining groove, the second end of the releasing shaft can be inserted into a releasing groove formed on the clutch locking block by pressing the first end of the releasing shaft. Thus, the clutch locking blocks are moved laterally inward, released from the retaining groove, and therefore no longer embedded in the retaining groove, allowing the first end of the inner tube to move toward the first end of the outer tube when subjected to an external force, thereby forming a short stick in which the inner tube has been telescoped into the outer tube. Hence, the tubes can be expanded into a long stick simply by pulling the inner tube and be easily collapsed into a short stick by pressing the releasing shaft.

BRIEF DESCRIPTION OF THE SEVERAL VIEWS OF THE DRAWINGS

The form and structure of the present invention as well as the objects, features, and effects of the device disclosed herein will be best understood by referring to the following detailed description of some illustrative embodiments in conjunction with the accompanying drawings, in which.

DETAILED DESCRIPTION OF THE INVENTION

The present invention discloses an expansion/collapse control mechanism for a police baton. Please refer to FIG. 2 for an embodiment of the present invention, in which the police baton 2 is assembled from an outer tube 2A and an inner tube 2B, and the tubes 2A and 2B are telescopically connected to each other. It should be noted that the police baton of the present invention may be assembled from more than two tubes, but the expansion/collapse control mechanism between each two adjacent tubes remains the same. Hence, in the description that follows, only two tubes are used by way of example. It should also be noted that the outer tube 2A and the inner tube 2B are described according to their relative positions; that is to say, the outer tube 2A and the inner tube 2B refer respectively to the outer one and the inner one of the telescopically connected assembly of the two tubes.

Figure 1:
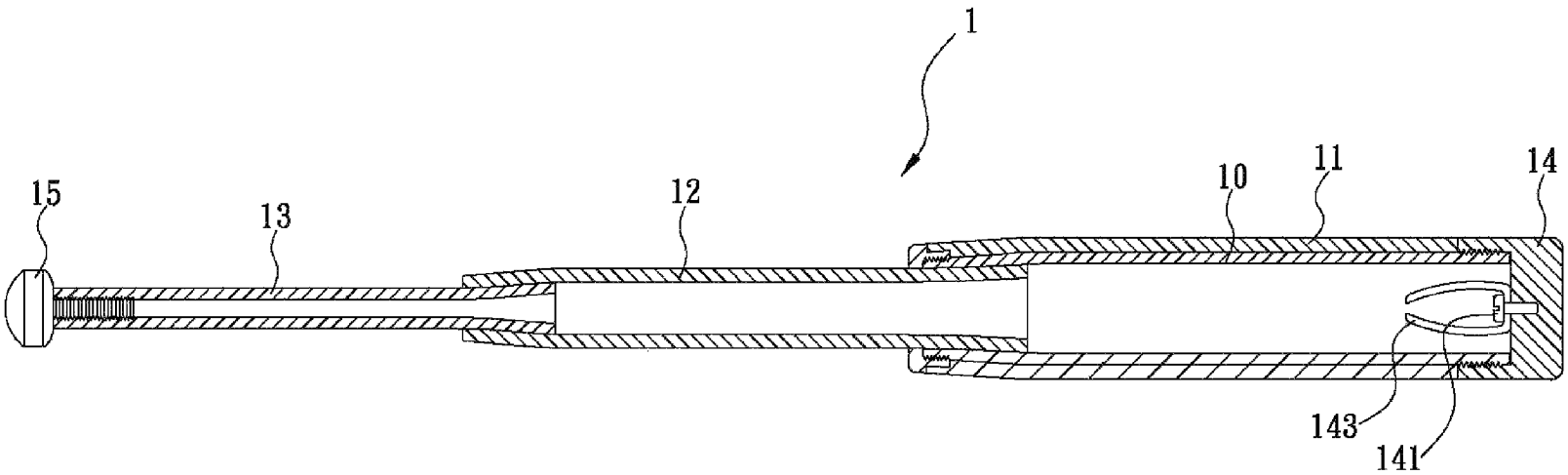
FIG. 1 (Prior Art)
FIG. 1 is a cross-sectional view of a conventional expandable police baton.
Figure 2:
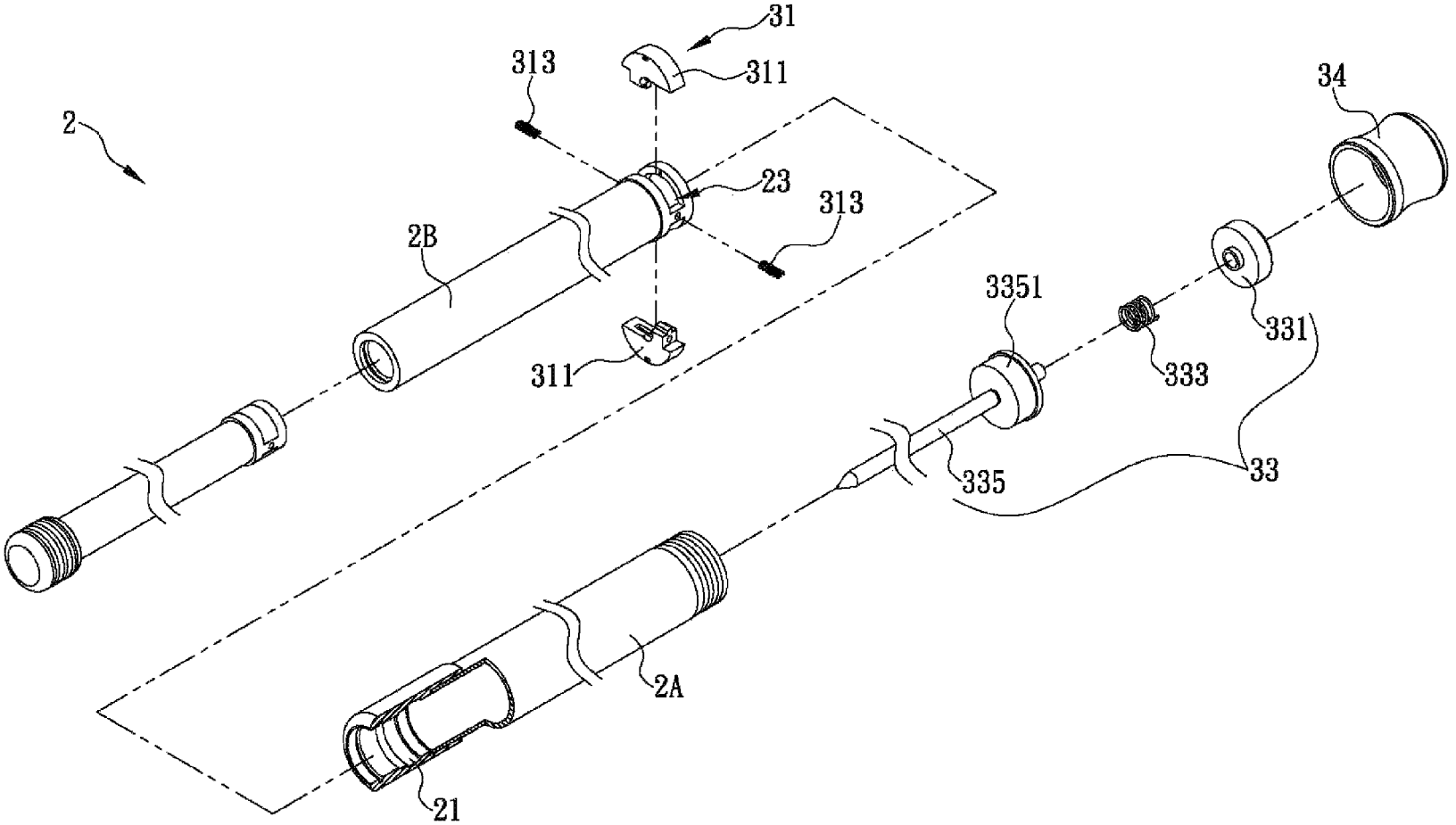
FIG. 2 is an exploded perspective view of a police baton in accordance with the present invention.

Referring to FIG. 2, a first end (the right end as shown in the drawing) of the outer tube 2A is larger in inner diameter than a second end (the left end as shown in the drawing) of the outer tube 2A, and a first end (the right end as shown in the drawing) of the inner tube 2B is larger in outer diameter than a second end (the left end as shown in the drawing) of the inner tube 2B. Moreover, the outer diameter of the first end of the inner tube 2B is greater than the inner diameter of the second end of the outer tube 2A and is less than the inner diameter of the first end of the outer tube 2A. Therefore, the tube 2A and the tube 2B can be telescopically connected together by passing the second end of the inner tube 2B through the outer tube 2A by way of the first end of the outer tube 2A. The second end of the inner tube 2B can be further moved to be exposed from the second end of the outer tube 2A until the first end of the inner tube 2B is adjacent to the second end of the outer tube 2A. Thanks to the differences between the inner and outer diameters of the tubes 2A and 2B, the first end of the inner tube 2B will not separate from the second end of the outer tube 2A after the second end of the inner tube 2B is exposed from the outer tube 2A. Moreover, the inner wall of the outer tube 2A is provided with at least one retaining groove 21 adjacent to the second end of the outer tube 2A, in which the retaining groove 21 may be arranged on the inner wall of the outer tube 2A in an annular or arcuate manner, depending on product requirements.

Figure 3:
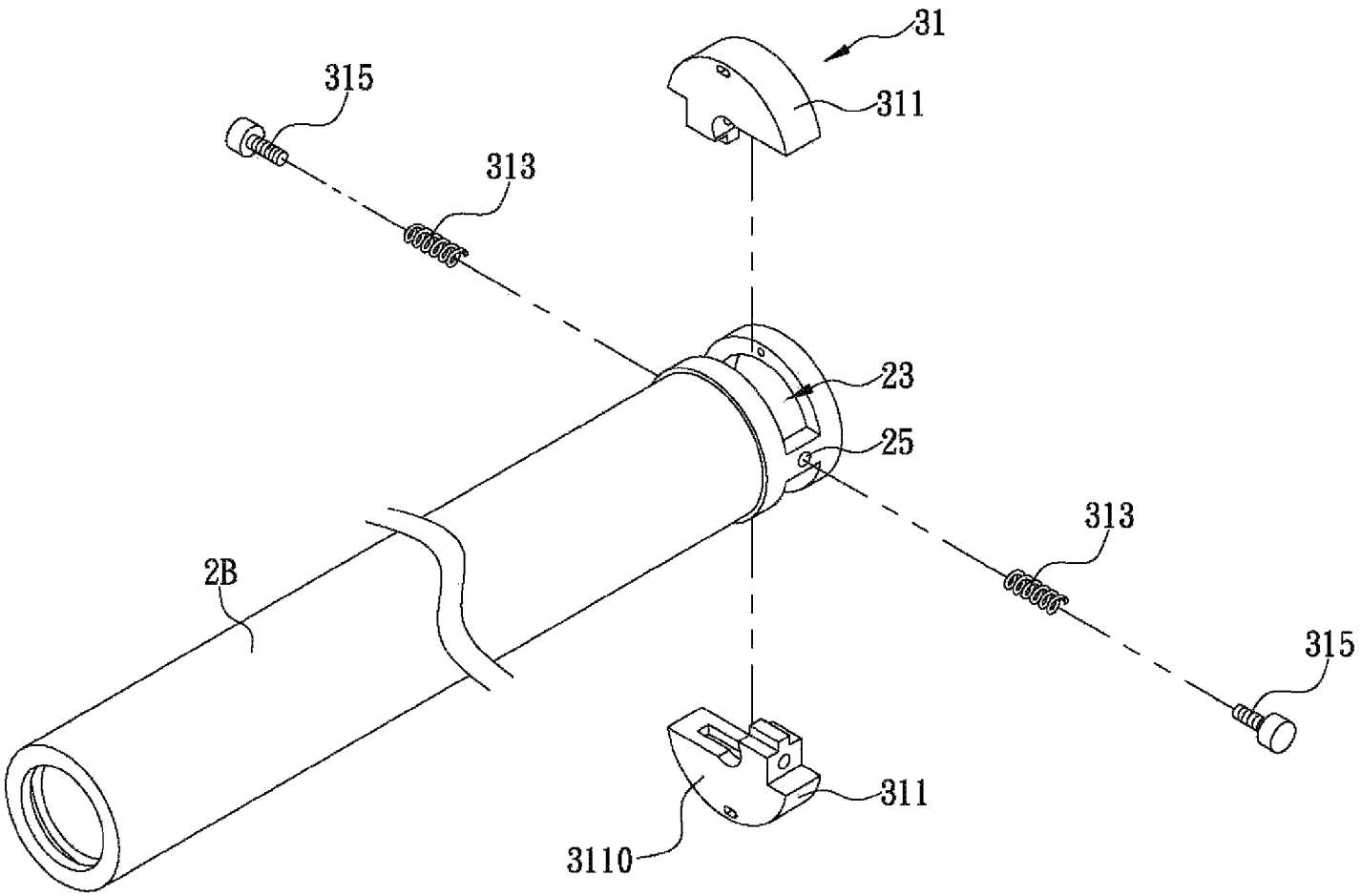
FIG. 3 is an exploded perspective view of a clutch locking mechanism and an inner tube in accordance with the present invention.
Figure 4B:
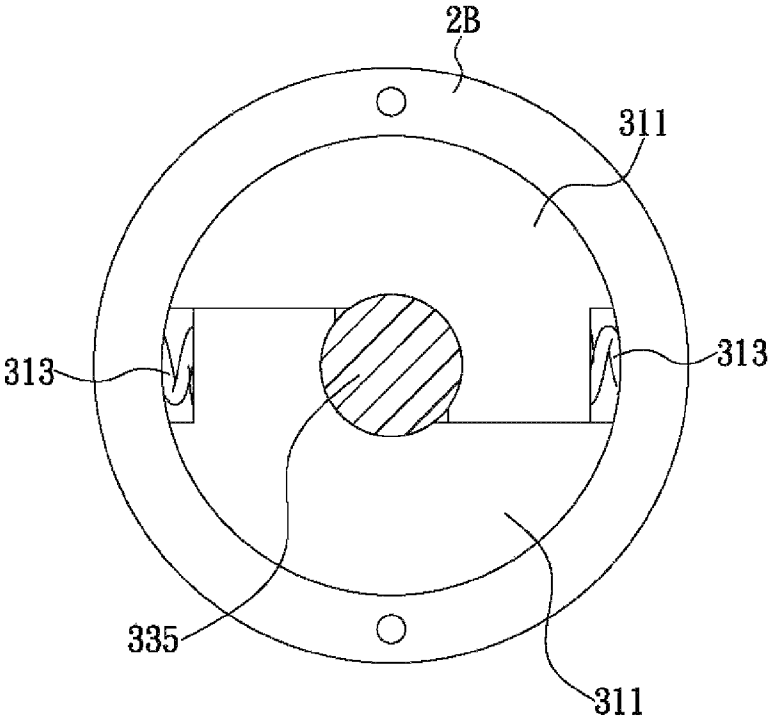
FIG. 4B shows another use mode of the clutch locking mechanism of the present invention.
Figure 4A:
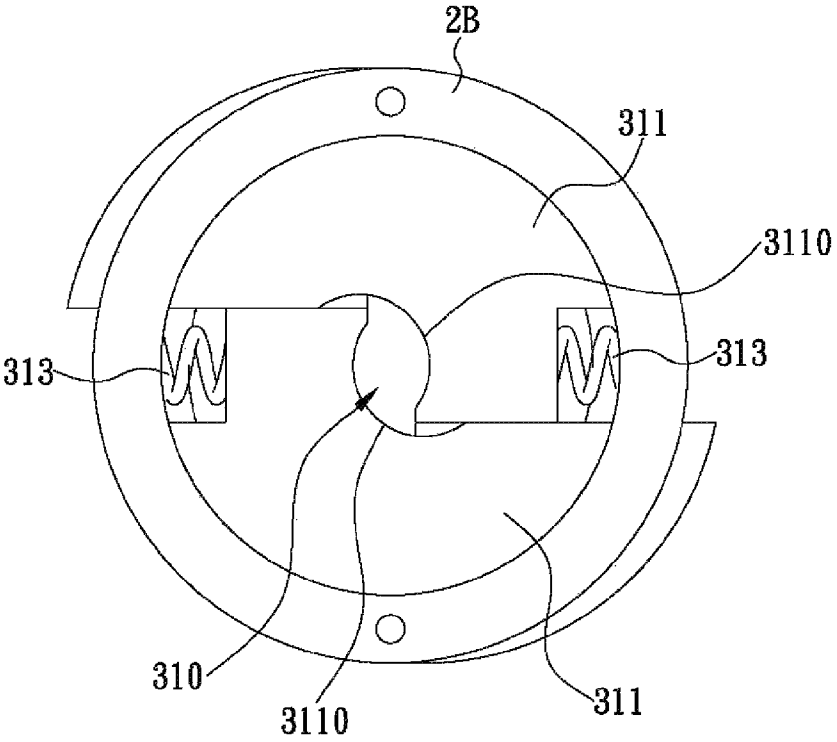
FIG. 4A shows a use mode of the clutch locking mechanism of the present invention.

Referring to FIG. 2 and FIG. 3, the expansion/collapse control mechanism includes a clutch locking mechanism 31 and a releasing mechanism 33, in which the clutch locking mechanism 31 is provided on, and adjacent to the first end of, the inner tube 2B. In the present embodiment, two through holes 23 are provided at a rim of the inner tube 2B that is adjacent to the first end of the inner tube 2B, and the clutch locking mechanism 31 includes two clutch locking blocks 311 and two elastic members 313. Each of the clutch locking blocks 311 is pivotally provided in one of the through holes 23 and can move back and forth through the corresponding through hole 23. There is a concavely curved portion 3110 on each of the opposing inner surfaces of the clutch locking blocks 311, in which the opposing, concavely curved portions 3110 jointly form a releasing groove 310 (as shown in FIG. 4A) between the two clutch locking blocks 311. The elastic members 313 are each provided between the inner tube 2B and one of the clutch locking blocks 311. Each elastic member 313 can apply a force to the corresponding clutch locking block 311, pushing the clutch locking block 311 further into the inner tube 2B. In this embodiment, the aforesaid rim of the inner tube 2B is provided with two corresponding locking holes 25 (only one of which is shown in FIG. 3). Each elastic member 313 has one end pressed against the corresponding clutch locking block 311 and the opposite end extending into the corresponding locking hole 25. In addition, two locking components 315 are fastened in the locking holes 25 respectively so as to position the elastic members 313 between the clutch locking blocks 311 and the locking holes 25, thereby preventing the elastic members 313 from falling out of the inner tube 2B. As shown in FIG. 4A and FIG. 4B, when the clutch locking blocks 311 are pushed by their respective elastic members 313, the concavely curve portions 3110 of the clutch locking blocks 311 move toward each other, and the clutch locking blocks 3110 will eventually and partially protrude from the surface of the outer wall of the inner tube 2B. When the clutch locking blocks 311 are forced to press the corresponding elastic members 313 respectively, the concavely curved portions 3110 of the clutch locking blocks 311 are moved away from each other, and the clutch locking blocks 311 will, in the end, be kept from protruding from the surface of the outer wall of the inner tube 2B. It should be noted that it is feasible in another embodiment of the present invention to use only one clutch locking block 311, one elastic member 313, and one through hole 23, depending on product requirements, and, in that case, the releasing groove 310 is formed between the concavely curved portion 3110 of the clutch locking block 311 and the inner wall of the inner tube 2B.

Referring to FIG. 2, the releasing mechanism 33 is fixedly provided at the first end of the outer tube 2A and at least includes a button 331, a spring 333, and a releasing shaft 335. In the present embodiment, once the releasing mechanism 33 is connected to the outer tube 2A, a first end of the button 331 is exposed from the first end of the outer tube 2A, and the second end of the button 331 is connected to a first end of the releasing shaft 335. The spring 333 is provided between the second end of the button 331 and the first end of the releasing shaft 335. A second end of the releasing shaft 335 can extend into the inner tube 2B by way of the first end of the outer tube 2A. The releasing shaft 335 is provided with a connecting block 3351 adjacent to the first end of the releasing shaft 335, in which the connecting block 3351 can be fixedly connected to the outer tube 2A, with one end of the spring 333 pressing against the connecting block 3351. When the button 331 is moved toward the first end of the outer tube 2A by an external force, the spring 333 is compressed and applies a force to the button 331; when the external force acting on the button 331 is removed, the force of the spring 333 pushes the button 331 away from the first end of the outer tube 2A and moves the releasing shaft 335 at the same time. To prevent the releasing mechanism 33 from loosening, the first end of the outer tube 2A is further provided with a cover 34. The cover 34 is formed as a hollow tube so that the button 331 can be partially exposed while the non-exposed portion of the button 331 is restricted by the cover 34, preventing the button 331 from falling off. In other embodiments of the present invention, the connecting block 3351 may be directly fixed on the outer tube 2A instead of being a separate component.

Referring to FIGS. 2, 4A, and 4B, once the inner tube 2B is forced to move outward of the second end of the outer tube 2A and the first end of the inner tube 2B is pressed against the second end of the outer tube 2A, the clutch locking blocks 311 correspond in position to the retaining groove 21. Because the releasing groove 310 in this state contains no component therein, each elastic member 313 pushes the corresponding clutch locking block 311 and thereby brings the concavely curved portions 3110 of the clutch locking blocks 311 toward each other (as shown in FIG. 4A); consequently, the clutch locking blocks 311 protrude partially from the surface of the outer wall of the inner tube 2B and are embedded in the retaining groove 21. Retained by the clutch locking blocks 311, the first end of the inner tube 2B is positioned in the second end of the outer tube 2A and kept from moving. Thus, the tubes 2A and 2B are expanded and form a stable long stick. When the first end of the button 331 is subsequently pressed, the button 331 pushes the releasing shaft 335 so as for the second end of the releasing shaft 335 to stick into the releasing groove 310 (as shown in FIG. 4B), thereby driving the clutch locking blocks 311 laterally inward to compress the elastic members 313 respectively; meanwhile, the clutch locking blocks 311 are released from the retaining groove 21. Once the first end of the inner tube 2B is forced to move toward the first end of the outer tube 2A, the inner tube 2A is telescoped into the outer tube 2B, thereby forming a short stick.

Figure 5:
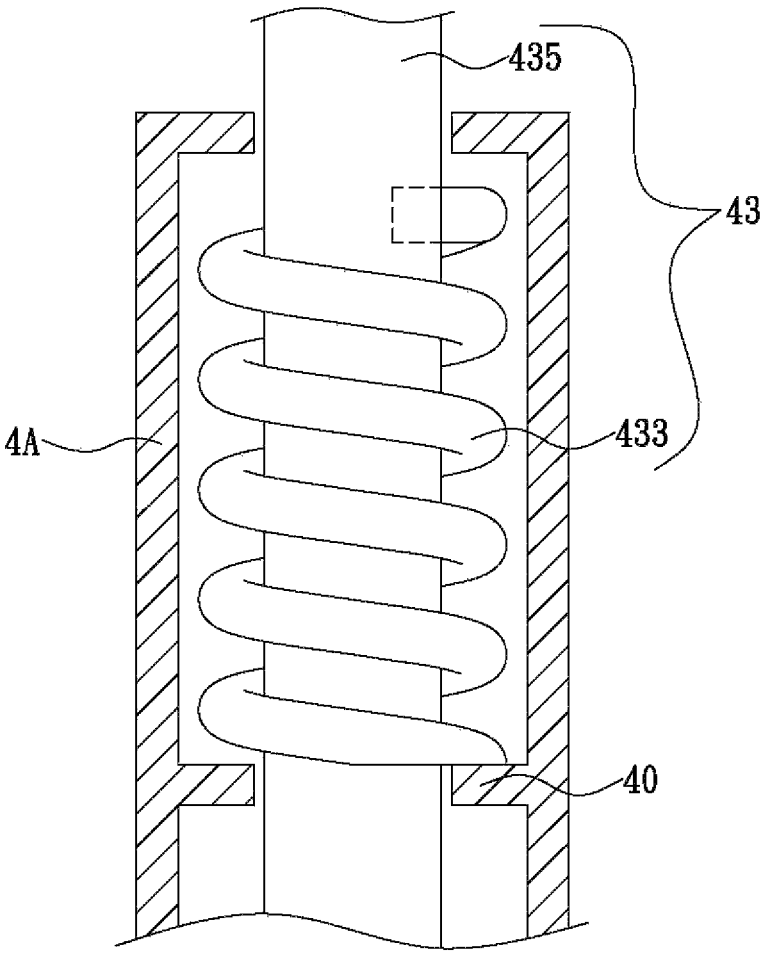
FIG. 5 is a schematic view of an alternative structure of a releasing mechanism in accordance with of the present invention.

The releasing mechanism in the foregoing embodiment of the present invention can be simplified in design. Please refer to FIG. 5 for another embodiment of the releasing mechanism of the present invention, in which only relevant components of the releasing mechanism 43 are shown. The operating principle of the releasing mechanism 43 is the same as that described in the previous embodiment and therefore will not be described repeatedly. The releasing mechanism 43 includes a releasing shaft 435 and a spring 433. A first end of the releasing shaft 435 is exposed from the first end of the outer tube 4A so that the releasing shaft 435 can be forced. The second end of the releasing shaft 435 can extend into the inner tube (not shown in FIG. 5) by way of the first end of the outer tube 4A. The spring 433 is provided between the outer wall of the releasing shaft 435 and the inner wall of the outer tube 4A. A first end of the spring 433 is fixed on the releasing shaft 435 while a second end of the spring 433 is connected to an inner portion of the outer tube 4A. In yet another embodiment of the present invention, the inner wall of the outer tube 4A is protrudingly provided with a shoulder 40, and the second end of the spring 433 is pressed against the shoulder 40. When the first end of the releasing shaft 435 is pressed, the spring 433 is compressed and produces an elastic force so as for the releasing shaft 435 to return to its original position. It should be noted that, in still another embodiment of the present invention, the second end of the spring 433 may be directly embedded in the outer tube 4A. Moreover, the releasing mechanism of the present invention is not limited to the design aspects shown in FIG. 2 and FIG. 5, provided that the releasing mechanism includes a releasing shaft whose first end can be pressed by the user and whose second end can extend into the inner tube by way of the first end of the outer tube so that, when the clutch locking blocks are embedded in the retaining groove and the first end of the releasing shaft is pressed, the second end of the releasing shaft is inserted into the releasing groove of the clutch locking mechanism to drive the clutch locking blocks laterally inward and release the clutch locking blocks from the retaining groove, thereby allowing the first end of the inner tube to move toward the first end of the outer tube when forced.

Referring to FIG. 2 again, the outer tube 2A and the inner tube 2B, once forming a long stick, are fixed to each other through the clutch locking mechanism 31 (i.e., the clutch locking blocks 311 and the elastic members 313) rather than through a tight fit attributable only to the differences between the inner and outer diameters of the two tubes, which is the case of the conventional expandable police batons. Hence, the police baton 2 disclosed in the present invention is less prone to wear and tear at the joint of the tubes. In addition, the user only has to press the button 331 of the releasing mechanism 33, and the outer tube 2A and the inner tube 2B will be rapidly collapsed into a short stick, without the user having to hit the inner tube 2B as is required for a conventional expandable police baton. Therefore, damage to the police baton 2 is greatly reduced, and noise generated from collapsing the police baton 2 is avoided.

While the invention herein disclosed has been described by means of specific embodiments, numerous modifications and variations could be made thereto by those skilled in the art without departing from the scope of the invention set forth in the claims.

What is claimed is:

1. A police baton having an outer tube and an inner tube telescopically connected to the outer tube, and an expansion/collapse control mechanism comprising:

a clutch locking mechanism provided adjacent to a first end of the inner tube, the clutch locking mechanism comprising at least a clutch locking block and at least an elastic member, the elastic member having two ends respectively pressed against the clutch locking block and an inner wall of the inner tube, the inner tube having a second end which can pass through the outer tube by way of a first end of the outer tube and be exposed from a second end of the outer tube, a retaining groove being provided on an inner wall of the outer tube and adjacent to the second end of the outer tube, wherein when the inner tube is forced to move outward of the second end of the outer tube such that the first end of the inner tube is pressed against the second end of the outer tube, the clutch locking block is moved laterally outward by an elastic force of the elastic member and becomes embedded in the retaining groove; and a releasing mechanism fixedly provided at the first end of the outer tube and comprising a releasing shaft, the releasing shaft having a first end to be forced by a user and a second end extendable into the inner tube by way of the first end of the outer tube so that, when the clutch locking block is embedded in the retaining groove, the second end of the releasing shaft can be inserted into a releasing groove formed on the clutch locking block by pressing the first end of the releasing shaft such that the clutch locking block is moved laterally inward, released from the retaining groove, and no longer embedded in the retaining groove, allowing the first end of the inner tube to move toward the first end of the outer tube when being forced.

2. The police baton of claim 1, wherein the releasing mechanism further comprises a spring provided between an outer wall of the releasing shaft and the inner wall of the outer tube, the first end of the releasing shaft is exposed from the first end of the outer tube, and the second end of the releasing shaft is extendable into the outer tube by way of the first end of the outer tube so that, when the clutch locking block is embedded in the retaining groove, the second end of the releasing shaft can be inserted into the releasing groove by pressing the first end of the releasing shaft such that the clutch locking block is moved laterally inward, released from the retaining groove, and no longer embedded in the retaining groove.

3. The police baton of claim 2, wherein the clutch locking block has an inner surface provided with a concavely curved portion forming the releasing groove.

4. The police baton of claim 3, wherein the inner tube has a rim adjacent to the first end of the inner tube and provided with at least a through hole, and the clutch locking block is pivotally provided in, and movable back and forth through, the through hole so that the clutch locking block can protrude partially from a surface of an outer wall of the inner tube and be embedded in the retaining groove or the clutch locking block can no more protrude from the surface of the outer wall of the inner tube and is therefore no longer embedded in the retaining groove.

5. The police baton of claim 4, wherein the rim of the inner tube is provided with at least a locking hole, one said end of the elastic member is pressed against the clutch locking block, the other end of the elastic member extends into the locking hole, and the locking hole is fastened with a locking component so as for the elastic member to be positioned between the clutch locking block and the locking hole, and for the clutch locking block to protrude partially from the surface of the outer wall of the inner tube and be embedded in the retaining groove due to the elastic force of the elastic member.

6. The police baton of claim 5, wherein the releasing shaft is provided with a connecting block adjacent to the first end of the releasing shaft, the connecting block is fixedly connectable to the outer tube, and the spring has an end pressing against the connecting block.

7. The police baton of claim 5, wherein the outer tube is provided with a connecting block, and the spring has an end pressing against the connecting block.

8. The police baton of claim 1, wherein the releasing mechanism further comprises a button and a spring, the button has a first end exposed from the first end of the outer tube, the spring is provided between a second end of the button and the first end of the releasing shaft, and the second end of the releasing shaft is extendable into the outer tube by way of the first end of the outer tube so that, when the clutch locking block is embedded in the retaining groove, the second end of the releasing shaft can be inserted into the releasing groove by pressing the first end of the button such that the clutch locking block is moved laterally inward, released from the retaining groove, and no longer embedded in the retaining groove.

9. The police baton of claim 8, wherein the clutch locking block has an inner surface provided with a concavely curved portion forming the releasing groove.

10. The police baton of claim 9, wherein the inner tube has a rim adjacent to the first end of the inner tube and provided with at least a through hole, and the clutch locking block is pivotally provided in, and movable back and forth through, the through hole so that the clutch locking block can protrude partially from a surface of an outer wall of the inner tube and be embedded in the retaining groove or the clutch locking block can no more protrude from the surface of the outer wall of the inner tube and is therefore no longer embedded in the retaining groove.

11. The police baton of claim 10, wherein the rim of the inner tube is provided with at least a locking hole, one said end of the elastic member is pressed against the clutch locking block, the other end of the elastic member extends into the locking hole, and the locking hole is fastened with a locking component so as for the elastic member to be positioned between the clutch locking block and the locking hole, and for the clutch locking block to protrude partially from the surface of the outer wall of the inner tube and be embedded in the retaining groove due to the elastic force of the elastic member.

12. The police baton of claim 11, wherein the releasing shaft is provided with a connecting block adjacent to the first end of the releasing shaft, the connecting block is fixedly connectable to the outer tube, and the spring has an end pressing against the connecting block.

13. The police baton of claim 11, wherein the outer tube is provided with a connecting block, and the spring has an end pressing against the connecting block.

* * * * *